US009416594B2

(12) United States Patent
Jeffryes et al.

(10) Patent No.: US 9,416,594 B2
(45) Date of Patent: Aug. 16, 2016

(54) SYSTEM AND METHOD FOR DRILLING A BOREHOLE

(71) Applicant: SCHLUMBERGER TECHNOLOGY CORPORATION, Sugar Land, TX (US)

(72) Inventors: Benjamin P. Jeffryes, Histon (GB); Iain Cooper, Sugar Land, TX (US); Simon H. Bittleston, Newmarket (GB); Geoffrey C. Downton, Minchinhampton (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 185 days.

(21) Appl. No.: 14/037,037

(22) Filed: Sep. 25, 2013

(65) Prior Publication Data

US 2014/0027178 A1 Jan. 30, 2014

Related U.S. Application Data

(60) Continuation-in-part of application No. 13/344,535, filed on Jan. 5, 2012, now Pat. No. 8,567,527, which is a division of application No. 11/667,231, filed as application No. PCT/GB2005/004424 on Nov. 16, 2005, now Pat. No. 8,109,345.

(30) Foreign Application Priority Data

Nov. 17, 2004 (GB) ..... 0425312.6

(51) Int. Cl.
*E21B 7/15* (2006.01)
*E21B 7/10* (2006.01)
(Continued)

(52) U.S. Cl.
CPC ... *E21B 7/10* (2013.01); *E21B 7/06* (2013.01); *E21B 7/068* (2013.01); *E21B 7/15* (2013.01); *E21B 10/60* (2013.01); *E21C 37/16* (2013.01); *E21C 37/18* (2013.01)

(58) Field of Classification Search
CPC ..... E21B 7/10; E21B 7/06; E21B 7/15; E21B 10/60; E21B 7/068; E21C 37/16; E21C 37/18
See application file for complete search history.

(56) References Cited

U.S. PATENT DOCUMENTS 3,506,076 A 4/1970 Angona
3,539,221 A 11/1970 Gladstone et al.
(Continued)

FOREIGN PATENT DOCUMENTS

EP 1106777 A1 6/2001
WO 9807959 A1 2/1998
(Continued)

OTHER PUBLICATIONS

Andres, "Disintegration of rock by tension", Resources Processing, vol. 43(3), 1996, pp. 122-135.
(Continued)

*Primary Examiner* — Yong-Suk (Philip) Ro

(57) ABSTRACT

A system and method is provided for drilling a wellbore including a rotary drill bit with a bit body having a plurality of mechanical cutters to cut away formation material as the wellbore is formed; and a directed energy mechanism to direct energy into the formation such that energy from the directed energy mechanism causes fracturing of surrounding material to facilitate drilling in the direction of the directed energy. The energy from the directed energy mechanism is used to enhance the cutting of the mechanical cutters by fracturing surrounding material to facilitate drilling in the direction of the directed energy.

28 Claims, 7 Drawing Sheets

(51) Int. Cl.

| | |
|---|---|
| ***E21B 7/06*** | (2006.01) |
| ***E21C 37/16*** | (2006.01) |
| ***E21C 37/18*** | (2006.01) |
| ***E21B 10/60*** | (2006.01) |

(56) References Cited

U.S. PATENT DOCUMENTS

| | | | |
|---|---|---|---|
| 3,633,688 | A | 1/1972 | Bodine |
| 3,700,169 | A | 10/1972 | Naydan et al. |
| 4,474,250 | A | 10/1984 | Dardick |
| 4,479,680 | A | 10/1984 | Wesley et al. |
| 4,540,127 | A | 9/1985 | Andres |
| 4,582,147 | A | 4/1986 | Dardick |
| 4,667,738 | A | 5/1987 | Codina |
| 4,722,402 | A | 2/1988 | Weldon |
| 4,741,405 | A | 5/1988 | Moeny et al. |
| 5,018,590 | A | 5/1991 | Weldon |
| 5,421,420 | A | 6/1995 | Malone et al. |
| 5,845,854 | A | 12/1998 | Adam et al. |
| 5,896,938 | A | 4/1999 | Moeny et al. |
| 6,109,370 | A | 8/2000 | Gray |
| 6,164,388 | A | 12/2000 | Martunovich et al. |
| 6,192,748 | B1 | 2/2001 | Miller |
| 6,215,734 | B1 | 4/2001 | Moeny et al. |
| 7,147,064 | B2 | 12/2006 | Batarseh et al. |
| 2002/0011355 | A1 | 1/2002 | Wentworth et al. |
| 2004/0104052 | A1 | 6/2004 | Livingstone |
| 2004/0206505 | A1 | 10/2004 | Batarseh |

FOREIGN PATENT DOCUMENTS

| | | | |
|---|---|---|---|
| WO | 9922900 | A1 | 5/1999 |
| WO | 9924694 | A1 | 5/1999 |
| WO | 2004018827 | A1 | 3/2004 |
| WO | 2005054620 | A1 | 6/2005 |

OTHER PUBLICATIONS

Andres, "Electrical disintegration of rock", Mineral Processing and Extractive Metallurgy Review, vol. 14, 1995, pp. 87-110.

Gahan, et al., "Laser drilling: determination of energy required to remove rock", SPE 71466—SPE Annual Tech. Conference and Exhibition, New Orleans, 2001, 11 pages.

Goldfarb, et al., "Removal of surface layer of concrete by a pulseperiodical discharge", 11th IEEE Int Pulsed Power Conference, Baltimore, 1997, pp. 1078-1084.

Graves, et al., "StarWars laser technology applied to drilling and completing gas wells", SPE 49259—SPE Annual Tech Conference and Exhibition, New Orleans, Sep. 27-30, 1998, 10 pages.

Maurer, "Laser drills", Chapter 17 of Advanced Drilling Techniques, Petroleum Publishing Co., Tulsa, OK, 1980, pp. 421-463.

Maurer, "Spark drills", Chapter 21 of Advanced Drilling Techniques, Petroleum Publishing Co., Tulsa, OK, 1980, pp. 508-540.

O'Brien, et al., "StarWars Laser Technology for Gas Drilling and Completions in the 21st Century", SPE 56625—SPE Annual Technical Conference and Exhibition, Houston, Texas, Oct. 3-6, 1999, 10 pages.

International Search Report issued in PCT/GB2005/004424 on Feb. 6, 2006, 3 pages.

SYSTEM AND METHOD FOR DRILLING A BOREHOLE

CROSS-REFERENCE TO RELATED APPLICATIONS

This application is a continuation-in-part of U.S. patent application Ser. No. 13/344,535 filed Jan. 5, 2012; which is a divisional of U.S. patent application Ser. No. 11/667,231 filed Nov. 19, 2007, now U.S. Pat. No. 8,109,345 issued Feb. 7, 2012, which is a U.S. National Stage Application under 35 U.S.C. §371 and claims priority to Patent Cooperation Treaty Application No. PCT/GB2005/004424 filed Nov. 16, 2005; which claims priority to British Application No. GB0425312.6 filed Nov. 17, 2004. All of these applications are incorporated herein by reference in their entireties.

BACKGROUND

In a variety of subterranean environments, desirable production fluids exist. The fluids can be accessed and produced by drilling boreholes, i.e., wellbores, into the subterranean formation holding such fluids. For example, in the production of oil, one or more wellbores are drilled into or through an oil holding formation. The oil flows into the wellbore from which it is produced to a desired collection location. Wellbores can be used for a variety of related procedures, such as injection procedures. Sometimes wellbores are drilled generally vertically, but other applications utilize lateral or deviated wellbores.

Wellbores generally are drilled with a drill bit having a cutter rotated against the formation material to cut the borehole. Deviated sections of wellbore can be formed by "pushing the bit" in which the bit is pushed against a borehole wall as it is rotated to change the direction of drilling. In other applications, the deviated wellbore can be formed by "pointing the bit" in a desired direction and employing weight on the bit too move it in the desired direction. Another alternative is to use an asymmetric bit and pulse weight applied to the bit so that it tends to drill in a desired direction. However, each of these techniques presents problems in various applications. For example, problems can arise when the borehole size is over-gauge or the borehole rock is too soft. Other problems can occur when trying to drill at a relatively high angle through hard layers. In this latter environment, the drill bit often tends to follow softer rock and does not adequately penetrate the harder layers of rock.

In the international patent application WO 2005/054620, filed before, but published after the original filing date of this invention, there are described various electro-pulse drill bits including examples where the removal of cuttings are supported by mechanical cutters or scrapers and examples of non-rotary examples where the electro-pulses are given a desired direction.

SUMMARY

In general, the present invention provides a system and method for drilling wellbores in a variety of environments. A drill bit assembly incorporates a directed energy system to facilitate cutting of boreholes. Although the overall system and method can be used in many types of environments for forming various wellbores, the system is particularly useful as a steerable assembly used to form deviated wellbores.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to the drilling of wellbores. A drilling assembly is used to form generally vertical and/or deviated wellbores. A directed energy mechanism is utilized to fracture, spall or weaken formation material as the drilling assembly moves through a subterranean environment. The directed energy mechanism facilitates the drilling process and also can be used in a steerable drilling assembly to aid in steering the assembly to drill, for example, deviated wellbores. However, the devices and methods of the present invention are not limited to use in the specific applications that are described herein.

Figure 1A:
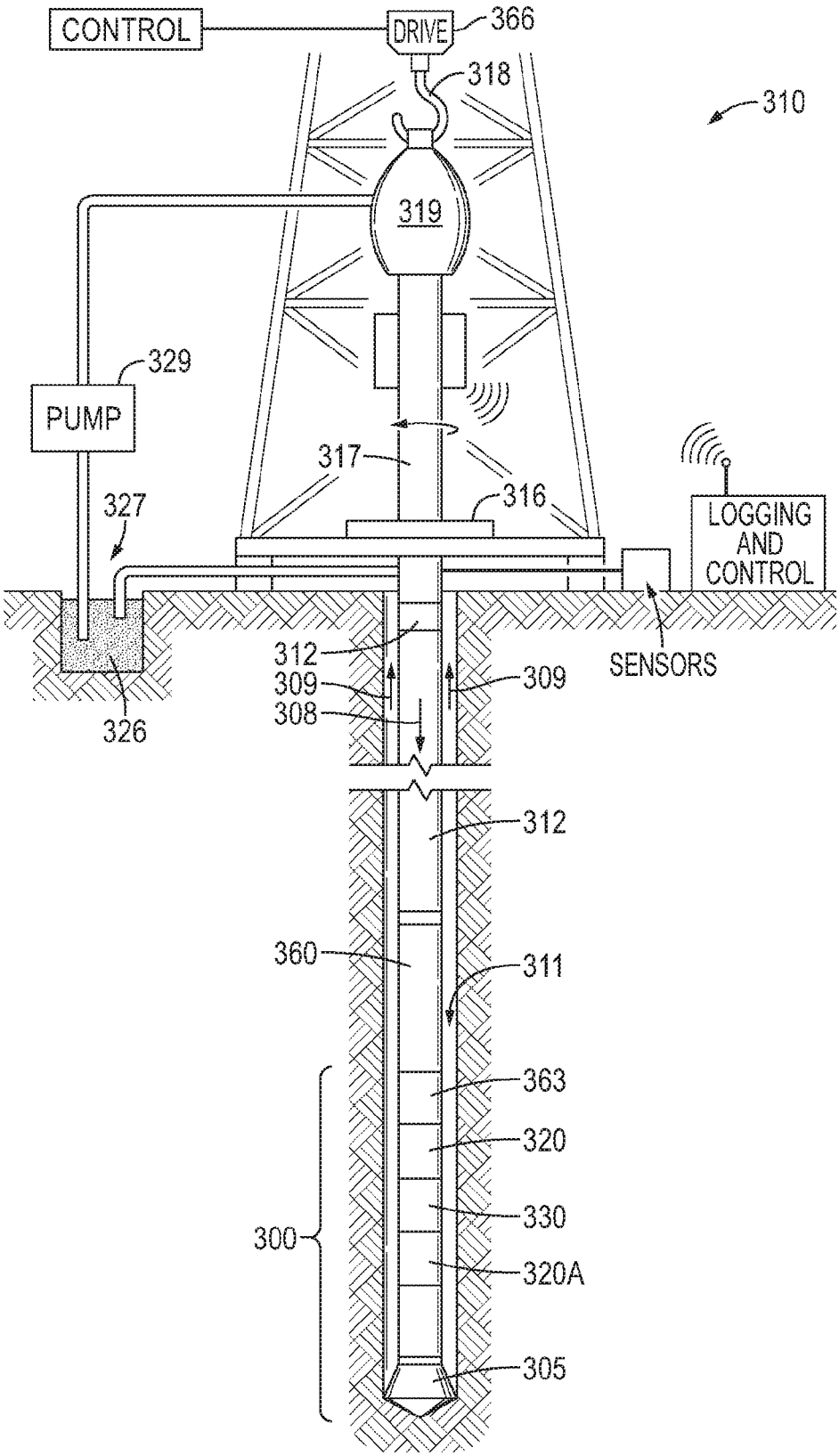
FIG. 1A illustrates a drilling system for operation at a wellsite to drill a borehole through an earth formation.

FIG. 1A illustrates a drilling system for operation at a wellsite to drill a borehole through an earth formation. The wellsite can be located onshore or offshore. In this exemplary system, a borehole 311 is formed in subsurface formations by rotary drilling in a manner that is well known. Embodiments of the invention can also use be used in directional drilling systems, pilot hole drilling systems, casing drilling systems and/or the like.

A drillstring 312 is suspended within the borehole 311 and has a bottomhole assembly 300, which includes a drill bit 305 at its lower end. The surface system includes a platform and derrick assembly 310 positioned over the borehole 311, the assembly 310 including a rotary table 316, kelly 317, hook 318 and rotary swivel 319. The drillstring 312 is rotated by the rotary table 316, energized by means not shown, which engages the kelly 317 at the upper end of the drillstring. The drillstring 312 is suspended from a hook 318, attached to a traveling block (also not shown), through the kelly 317 and the rotary swivel 319 which permits rotation of the drillstring relative to the hook. As is well known, a top drive system 366 could alternatively be used to rotate the drillstring 312 in the borehole and, thus rotate the drill bit 305 against a face of the earth formation at the bottom of the borehole.

In the depicted system, the surface system may further include drilling fluid or mud 326 stored in a pit 327 formed at the well site. A pump 329 delivers the drilling fluid 326 to the interior of the drillstring 312 via a port in the swivel 319, causing the drilling fluid to flow downwardly through the drillstring 312 as indicated by the directional arrow 308. The drilling fluid exits the drillstring 312 via ports in the drill bit 305, and then circulates upwardly through the annulus region between the outside of the drillstring and the wall of the borehole, as indicated by the directional arrows 309. In this well-known manner, the drilling fluid lubricates the drill bit 305 and carries formation cuttings up to the surface as it is returned to the pit 327 for recirculation.

The bottomhole assembly 300 of the illustrated system may include a logging-while-drilling (LWD) module 320, a measuring-while-drilling (MWD) module 330, a rotary-steerable system 363 and motor 360, and drill bit 305.

The LWD module 320 may be housed in a special type of drill collar, as is known in the art, and can contain one or a plurality of known types of logging tools. It will also be understood that more than one LWD and/or MWD module can be employed, e.g., as represented at 320A. The LWD module may include capabilities for measuring, processing and storing information, as well as for communicating with the surface equipment. In one embodiment, the LWD module may include a fluid sampling device.

The MWD module 330 may also be housed in a special type of drill collar, as is known in the art, and can contain one or more devices for measuring characteristics of the drillstring and drill bit. The MWD tool may further includes an apparatus (not shown) for generating electrical power to the downhole system. This may typically include a mud turbine generator powered by the flow of the drilling fluid, it being understood that other power and/or battery systems may be employed. In one embodiment, the MWD module may include one or more of the following types of measuring devices: a weight-on-bit measuring device, a torque measuring device, a vibration measuring device, a shock measuring device, a stick slip measuring device, a direction measuring device, a rotation speed measuring device, and an inclination measuring device.

Drilling an oil and/or gas well using the drilling system depicted in the figure may involve drilling a borehole of considerable length. Boreholes are often up to several kilometers vertically and/or horizontally in length. As depicted, the drillstring comprises a drill bit at its lower end and lengths of drill pipe that are screwed/coupled together. A drive mechanism at the surface rotates the drill bit against a face of the earth formation to drill the borehole through the earth formation. The drilling mechanism may be a top drive, a rotary table or the like.

The drillstring may undergo complicated dynamic behavior in the borehole during the drilling procedure, which complicated behavior may include axial, lateral and torsional vibrations as well as frictional and vibrational interactions with the borehole. Simultaneous measurements of drilling rotation at the surface and at the bit have revealed that while the top of the drill string rotates with a constant angular velocity, the drill bit may rotate with varying angular velocities. In extreme cases, known as stick-slip, the drill bit or another portion of the drillstring may stop rotating in the borehole, as a result, the drill string continues to be twisted/rotated until the bit rotates again, after which it accelerates to an angular velocity that is much higher than the angular velocity of the top of the drillstring.

Figure 1B:
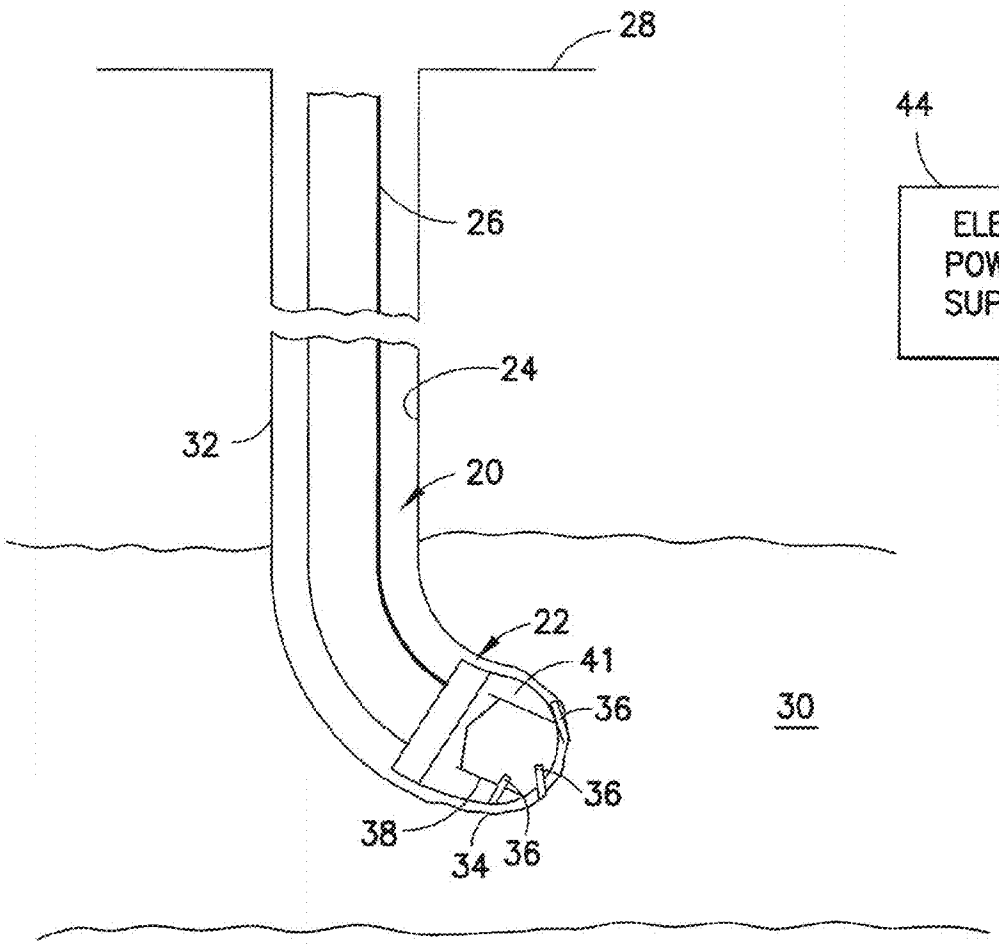
FIG. 1B is a front elevation view of a drilling assembly forming a wellbore, according to an embodiment of the present invention.

Referring generally to FIG. 1B, a system 20 is illustrated according to an embodiment of the present invention. In the particular embodiment illustrated, system 20 comprises a drilling assembly 22 used to form a borehole 24, e.g., a wellbore. Drilling assembly 22 is moved into the subterranean environment via an appropriate drill string 26 or other deployment system. Often, the wellbore 24 is drilled from a surface 28 of the earth downwardly into a desired formation 30. In the embodiment illustrated, the wellbore 24 has a generally vertical section 32 which transitions towards a deviated section 34 as drilling assembly 22 is steered to form the lateral wellbore.

In this example, drilling assembly 22 is a rotary, steerable drilling assembly having one or more fixed cutters 36 that are rotated against formation 30 to cut away formation material as the wellbore is formed. Drilling assembly 22 also comprises a directed energy mechanism 38 utilized to crack, break or weaken formation material proximate drilling assembly 22 as wellbore 24 is formed. The directed energy mechanism 38 directs energy, such as electromagnetic energy, against the formation to fracture or otherwise damage formation material. This non-cutting technique supplements the action of cutters 36 to facilitate formation of wellbore 24. Additionally, the non-cutting energy can be directed at specific regions of formation 30 to enable the steering of drilling assembly 22 even through hard or otherwise difficult to cut formation materials.

Figure 2:
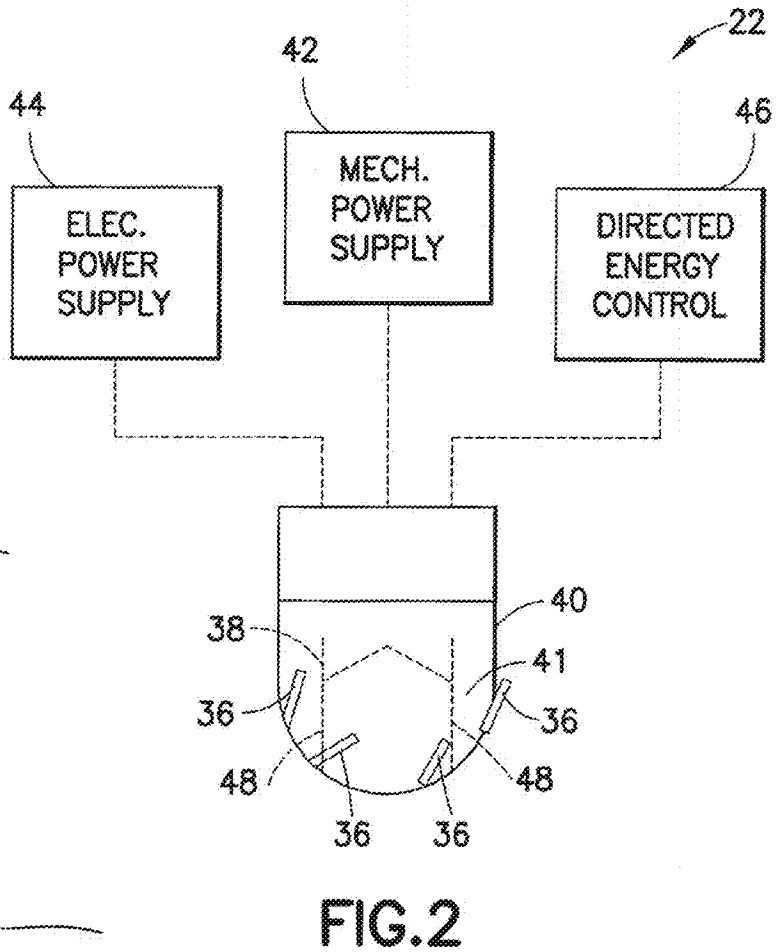
FIG. 2 is a schematic illustration of an embodiment of a drilling assembly that may be used with the system illustrated in FIG. 1.

Referring to FIG. 2, a schematic illustration is provided to show elements of one embodiment of drilling assembly 22. In this embodiment, drilling assembly 22 utilizes a drill bit 40 having a bit body 41 and one or more of the mechanical cutters 36 for cutting formation material. Mechanical cutters 36 are mounted on bit body 41. Drill bit 40 is rotated by a mechanical power source 42, such as an electric motor which may rotate the drillstring 26 either at the surface or downhole, and may also be rotated by a downhole electric motor or other means such as a hydraulic motor, examples of which are positive displacement motors and turbines. Additionally, electrical power is supplied by an electric power supply 44. The electrical power can be used to power directed energy mechanism 38 for providing a controlled fracturing of formation material proximate drill bit 40. Additionally, a directed energy controller 46 can be used to control the application of directed energy to the surrounding formation material.

The use of directed energy in conjunction with the mechanical bit enhances the cutting of formation materials, particularly materials such as hard rock. The directed energy can be delivered to formation 30 by, for example, directed energy members 48 that are distributed around the circumference of drill bit 40. As discussed more fully below, such directed energy members 48 can be used for side-cutting, i.e., causing drilling assembly 22 to turn in a desired direction by supplying energy to members on the side of the bit that coincides with the desired change in direction. If the rate of turn becomes excessive, the energy selectively sent to specific elements 48 can be interrupted for a proportion of the time, or more energy can be distributed to other sides of the drill bit to increase rock removal in other locations about drill bit 40. An example of directed energy is electromagnetic energy that may be supplied in a variety of forms.

Figure 5:
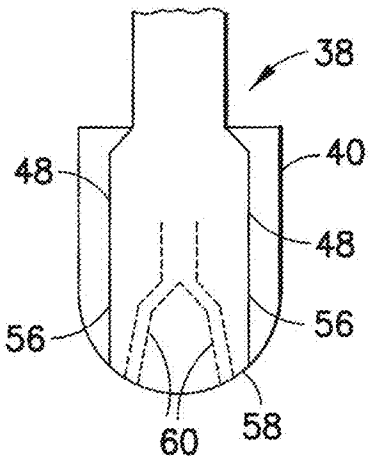
FIG. 5 is a schematic illustration of another alternate embodiment of a drill bit incorporating a directed energy mechanism that may be used with the system illustrated in FIG. 1.
Figure 4:
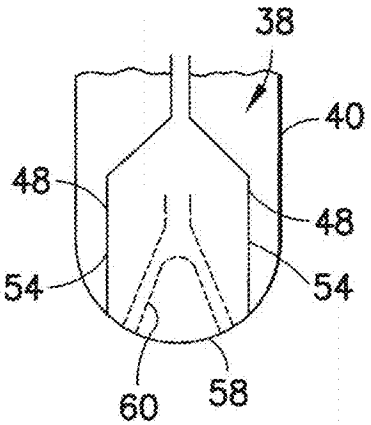
FIG. 4 is a schematic illustration of an alternate embodiment of a drill bit incorporating a directed energy mechanism that may be used with the system illustrated in FIG. 1.
Figure 3:
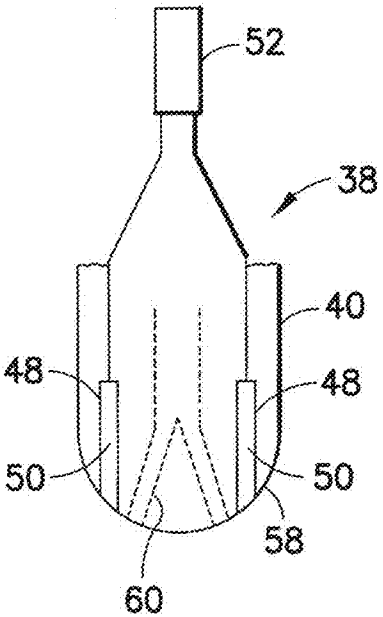
FIG. 3 is a schematic illustration of an embodiment of a drill bit incorporating a directed energy mechanism that may be used with the system illustrated in FIG. 1.

Examples of drill bits 40 combined with directed energy mechanisms 38 are further illustrated in FIGS. 3-5. The figures illustrate several embodiments able to utilize electromagnetic energy in fracturing subterranean materials to form boreholes. In FIG. 3, for example, directed energy members comprise a plurality of waveguides 50, such as fiber optics or gas/fluid filled members. In this embodiment, electrical power provided by electric power supply 44 is pulsed and converted by a laser 52 into pulsed optical power. The laser energy is directed at the formation material surrounding drill bit 40 via waveguides 50. The laser energy heats the rock and any fluid contained within the rock to a level that breaks the rock either through thermally induced cracking, pore fluid expansion or material melting. The target or formation material at which the laser energy is directed can be controlled by directed energy control 46. For example, a switching system can be used to direct the pulsed optical power to specific waveguides 50 when they are disposed along one side of drill bit 40. This, of course, facilitates directional turning of the drill bit to create, for example, a lateral wellbore.

In another embodiment, illustrated in FIG. 4, directed energy members 48 comprise a plurality of electrodes 54. Electrodes 54 can be utilized in delivering electromagnetic energy against the material surrounding drill bit 40 to break down the materials and enhance the wellbore forming capability of the drilling assembly. In this particular embodiment, electrodes 54 are used for electrohydraulic drilling in which drill bit 40 and directed energy mechanism 38 are submerged in fluid. Selected electrodes 54 are separated from a ground conductor and raised to a high-voltage until the voltage is discharged through the fluid. This produces a local fluid expansion and, hence, a pressure pulse. By applying the pressure pulse close to the formation material surrounding drill bit 40, the material is cracked or broken into pieces. This destruction of material can be enhanced by utilizing a phased electrode array. Again, by supplying the electrical power to selected electrodes 54, the breakdown of surrounding material can be focused along one side of drill bit 40, thereby enhancing the ability to steer the drilling assembly 22 in that particular direction.

Another embodiment of directed energy mechanism 38 is illustrated in FIG. 5. In this embodiment, electric energy is provided by electric power supply 44 and controlled by directed energy control 46 to provide electrical pulses to electrodes 56. The electric pulses enable electric pulsed drilling in which electrical potential is discharged through surrounding rock, as opposed to through surrounding fluid as with electrohydraulic drilling. As voltage is discharged through rock close to electrodes 56, the rock or other material is fractured to facilitate formation of the borehole 24. As with the other embodiments described above, electrical power can be selectively supplied to electrodes 56 along one side of drill bit 40 to enhance the steerability of drilling assembly 22.

In the embodiments discussed above, the directed energy members 48 rotate with drill bit 40. Thus, there is no need for components to remain mechanically stationary with respect to the surrounding formation. However, other designs and applications can utilize stationary components, such as a stationary directed energy mechanism.

Additionally, directed energy members 48 may be arranged in a variety of patterns and locations. As illustrated, each of the directed energy members 48 may be positioned to extend to a bit face 58 of drill bit 40. This facilitates transfer of directed energy to the closely surrounding formation material, thus enhancing breakdown of the proximate formation material. Drill bit 40 may be constructed in a variety of forms with various arrangements of mechanical cutters 36 connected to bit body 41. For example, mechanical cutters 36 may be fixed to bit body 41 and/or the drill bit can be formed as a bi-center bit. Additionally, passages 60 can be formed through drill bit 44 to conduct drilling fluid therethrough. Passages 60 can be formed directly in bit body 41, or they can be incorporated into a replaceable nozzle to conduct drilling fluid through bit face 58. The drilling fluid conducted through passages 60 aids in washing cuttings away from drill bit 40. It should be noted that these are just a few examples of the many potential variations of drill bit 40, and that other types of drill bits can be utilized with directed energy mechanism 38.

Figure 6:
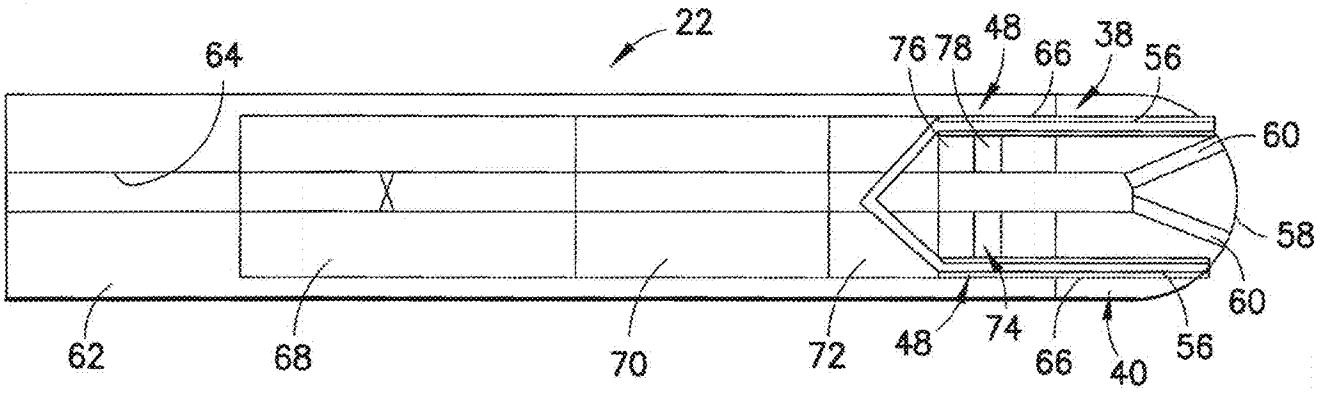
FIG. 6 is an elevation view of a drilling assembly disposed in a lateral wellbore, according to an embodiment of the present invention.

Referring to FIG. 6, a detailed example of one type of drilling assembly 22 is illustrated in which the drilling assembly comprises a rotary steerable drilling assembly. In this embodiment, drilling assembly 22 comprises drill collars 62 through which extends a flow passage 64 for delivering drilling fluid to outlet passages 60 that extend through bit face 58. In the embodiment illustrated, flow passage 64 lies generally along the centerline of collars 62, and other components surround the flow passage. However, in an alternate embodiment, components can lie along the centerline, and the drilling fluid can be routed through an annular passage.

As illustrated, directed energy mechanism 38 comprises directed energy members 48 in the form of electrodes 56, surrounded by an insulation material 66. Electric power is generated by, for example, a turbine 68 positioned as part of the steerable drilling assembly 22. However, the power generating turbine 68 also can be located remotely with respect to drilling assembly 22. Electric power generated by turbine 68 is used to charge a repetitive pulsed power unit 70. In this embodiment, pulsed power unit 70 is disposed between turbine 68 and drill bit 40, however, the components can be arranged in other locations. One example of a repetitive pulsed power unit 70 is a Marx generator.

The pulses output by pulsed power unit 70 may be compressed by a magnetic pulse compressor 72. In some applications, for example, the output from pulsed power unit 70 may not have a fast enough rise time for electric pulsed drilling. In such applications, the magnetic pulse compressor 72 may be used to compress the pulses. Between discharges through electrodes 56, the individual pulses can be switched between different electrodes 56. As discussed above, the utilization of specific electrodes disposed, for example, along one side of drill bit 40 substantially facilitates the steerability of drilling assembly 22.

A greater degree of control over the turning of drilling assembly 22 can be achieved with the aid of directed energy control 46 which, in this embodiment, comprises a directional sensor unit 74. Sensor unit 74 comprises, for example, accelerometers 76 and magnetometers 78 to determine through which electrode the pulse should be discharged to maintain or change the direction of drilling. In this example, electrodes 56 are arranged in a symmetric pattern around the lead face of drill bit 40. However, other arrangements of directed energy members 48 may be selected for other applications. Also, directed energy mechanism 38 is used in cooperation with mechanical cutters 36 to more efficiently form cuttings and provide greater steerability of the drilling assembly 22.

Figure 7:
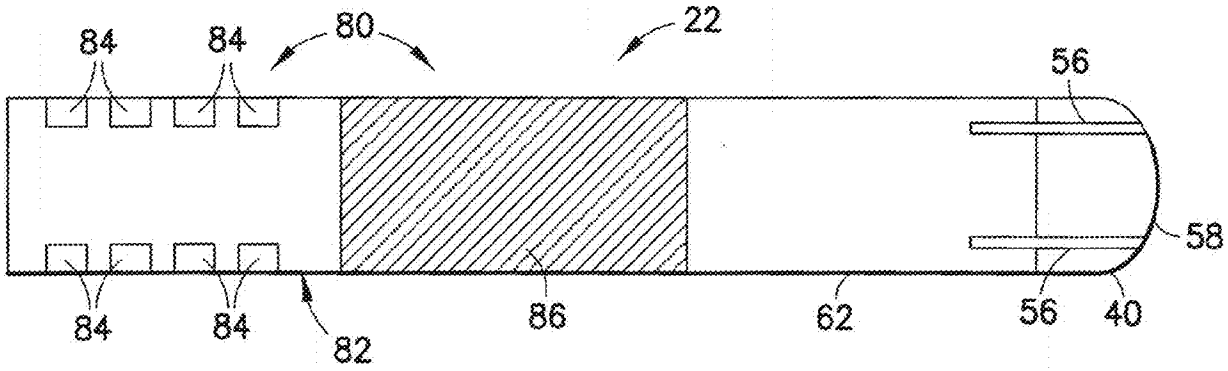
FIG. 7 is a front elevation view of another embodiment of a drilling assembly, according to an embodiment of the present invention.

Another embodiment of drilling assembly 22 is illustrated in FIG. 7. In this embodiment, drilling assembly 22 comprises an acoustic imaging system 80 for downhole formation imaging during drilling. Acoustic imaging system 80 comprises, for example, an acoustic receiver section 82 having an acoustic receiver and typically a plurality of acoustic receivers 84. By way of example, acoustic receivers 84 may comprise piezoelectric transducers. Acoustic receiver section 82 may be formed as a collar coupled to a damping section 86. Damping section 86 may be formed of a metal material able to provide damping of the acoustic waves transmitted therethrough to acoustic receivers 84. In other words, electrodes, such as electrodes 56, provide an acoustic source during the electric discharges used to break down formation material. Acoustic receivers 84 are used to sense the acoustic waves transmitted through and reflected from the different materials comprising the rock formation, providing the means to image the formation downhole while drilling.

Figure 8:
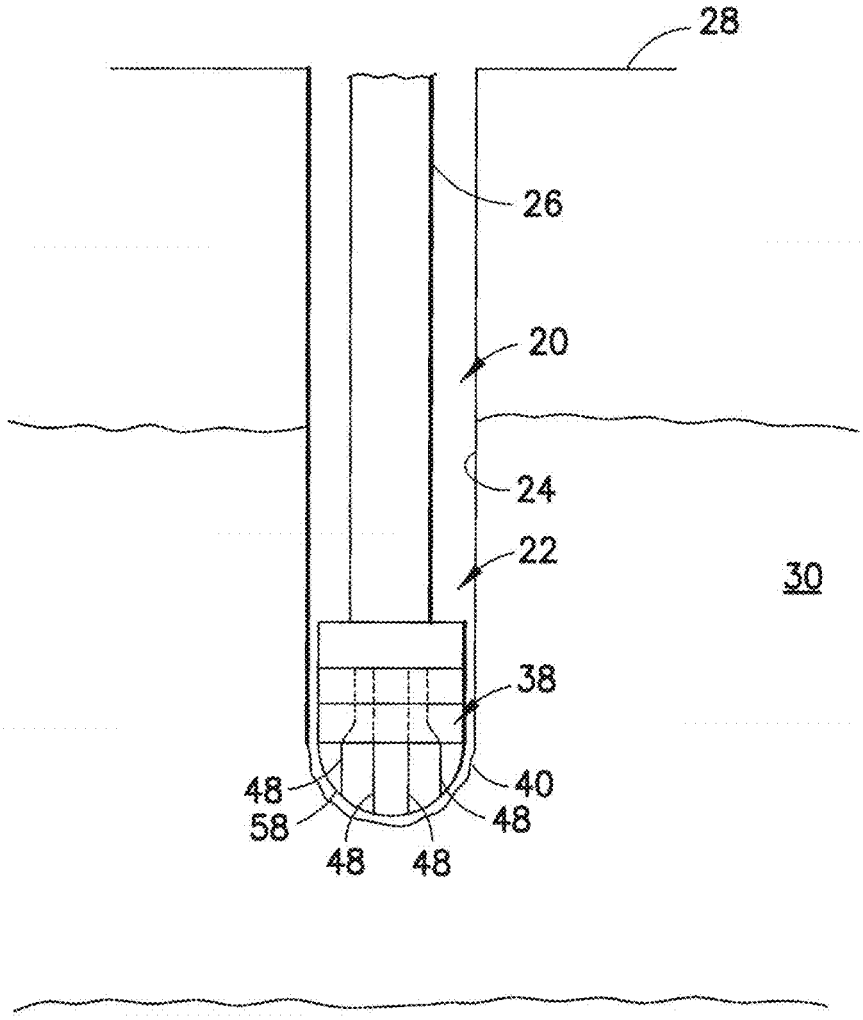
FIG. 8 is a front elevation view of another embodiment of a drilling assembly disposed in a well, according to an embodiment of the present invention.

It should be noted that the directed energy mechanism 38 can be used in a variety of drilling assemblies and applications. For example, although the use non-cutting directed energy substantially aids in the steerability of a given drilling assembly, the use of directed energy mechanism 38 also facilitates linear drilling. As illustrated in FIG. 8, directed energy mechanism 38 can be used with a variety of drill bits 40, including drill bits without mechanical cutters. Sufficient directed energy can sufficiently destruct formation materials without mechanical cutting. The resultant cuttings can be washed away with drilling fluid as in conventional systems. Additionally, the size, number and arrangement of directed energy members 48 can be changed according to the design of drilling assembly 22, the size of wellbore 24, the materials found information 30 and other factors affecting the formation of the borehole.

Furthermore, drilling assembly 22 is amenable to use with other or additional components and other styles of drill bits. For example, the directed energy mechanism 38 can be combined with drilling systems having a variety of configurations. Additionally, the directed energy mechanism can be combined with alternate steering assemblies, including "pointing the bit" and "pushing the bit" type steering assemblies.

One issue with using electromagnetic energy to assist/enhance mechanical drilling is delivery of the electromagnetic energy to the tool face/earth formation.

Figure 9B:
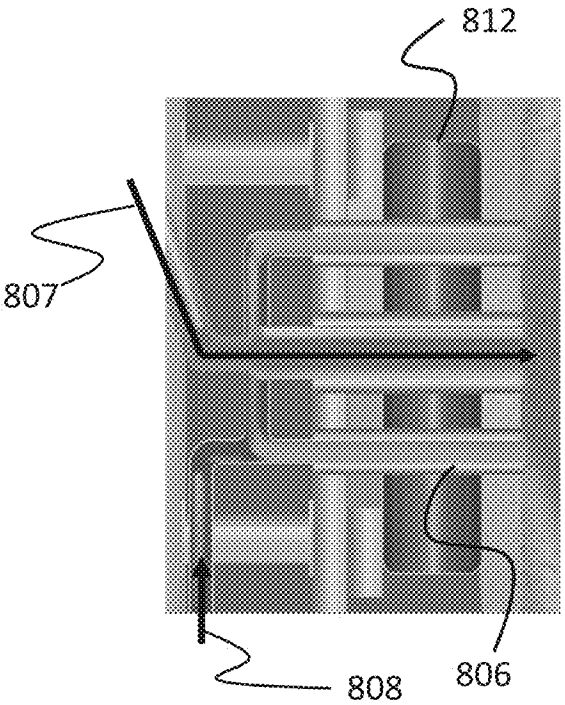
FIG. 9B illustrates a system for delivering laser energy to an earth formation being drilled by a combined mechanical-laser drilling system, in accordance with one embodiment of the present invention.
Figure 9A:
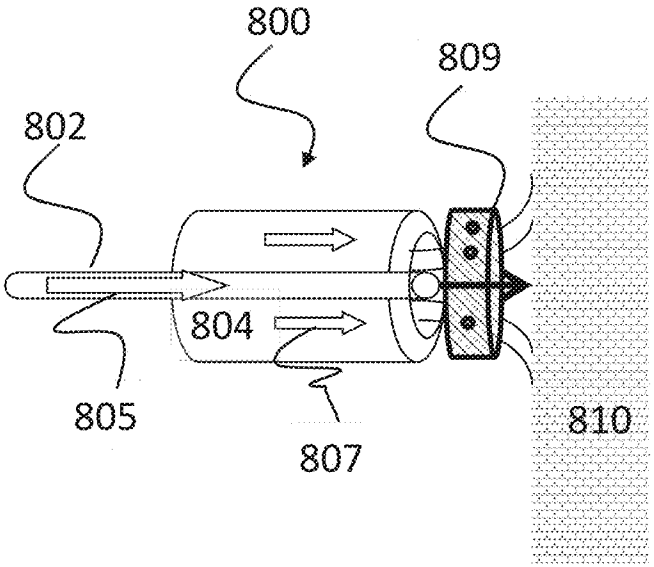
FIG. 9A illustrates a system for delivering laser energy to an earth formation being drilled by a combined mechanical-laser drilling system, in accordance with one embodiment of the present invention.

FIG. 9A illustrates a system for delivering laser energy to an earth formation being drilled by a combined mechanical-laser drilling system, in accordance with one embodiment of the present invention.

In FIG. 8A an earth formation 810 is being drilled by a drilling system (mechanical cutters, etc., not shown for clarity) comprising a laser delivery system 800 comprising laser energy 805 delivered through an optical fiber 802. The laser delivery system 800 includes an annulus 804 through which a fluid 807 can be delivered to the tool face. In embodiments of the present invention an optically clear, with respect to the laser energy being used, fluid may be delivered through the annulus 804 to provide for transmission of the laser energy 805 to the earth formation 810.

In some aspects the laser system 800 may extend beyond the optical fiber 802 or a guard 809 may be positioned on the end of the laser system 800 to help maintain the fluid 807 in front of the optical fiber 802 when the laser energy 805 is being transmitted through the optical fiber 802.

In the laser delivery system 800, a clear path is provided for the laser energy 805 to reach the earth formation 810. In aspects of the described system, flow rate of the fluid 807 may be selected/adjusted to be sufficient to provide a substantially clear channel between the end of the optical fiber 802 and the surface of the earth formation 810 being drilled. As the annular jet impinges on the surface it fans outwards ensuring a clear area of surface on which the photons can impinge.

In an oil well the wellbore may have fluids in motion. So in some aspects, the annular flow rate is selected to be sufficiently strong to ensure it is not unduly disturbed by any cross currents of opaque fluids. In embodiments of the present disclosure a fixed known distance between the end of the optical fiber and the surface, in which case an additional 'stand-off' construction can be made to hold the above device at a known distance from the surface. In some embodiments, the guard 809 may produce the desired stand-off. The guard 809 may include perforations and/or have a cage design to allow for flow of the fluid 807 through the guard 809.

It should also be noted that the optical fiber may be shorter, or longer, than the annulus 804. In aspects where it is shorter, a length of the delivery tube 801 extends beyond the optical fiber 802 in which the annular jet can converge within the delivery tube 801 to provide a cylindrical tube of clear fluid through which the laser energy 805 may pass. A variable focusing mechanism (not shown) may also be provided within the laser system 800 to allow for variety of cutting profiles, shapes and rate.

The above arrangement can also be used in a system in which the back-scatter of the laser energy 805 from the earth formation 810 is measured by a measuring system (not shown). In the depicted system, both the path from the end of the optical fiber 802 to the earth formation 810 and the return path for any backscattered energy is within the jet of clear fluid allowing the backscattered laser energy to be detected/measured.

In embodiments of the present disclosure, the laser system 800 may be combined with a mechanical drilling system. In some embodiments, the fluid 807 may be provided during a drilling procedure from a tool based reservoir. In some embodiments, the fluid 807 may assist in 'washing away' any swarf that is produced by the laser drilling and/or provide a more robust seal with the cut surface to ensure that laser standoff is optimized.

FIG. 9B illustrates a system for delivering laser energy to an earth formation being drilled by a combined mechanical-laser drilling system, in accordance with one embodiment of the present invention.

In some aspects of the present invention, a controller, not shown, may control fluid dispersal and laser operation and provide that the laser is fired a certain amount of time after the fluid 807 is pumped out of the drill bit and/or onto the earth formation being drilled.

In FIG. 9B, a second fluid 808 may be provided through a second annulus 806. The second fluid 808 may provide for washing away debris from the drilling and may also act as a guard flow that surrounds the fluid flow 807 and washes debris and/or drilling fluids away from the fluid flow 807. An elastomeric sealing element 812 may be used to seal the laser system 800 to the earth surface 810.

Figure 10:
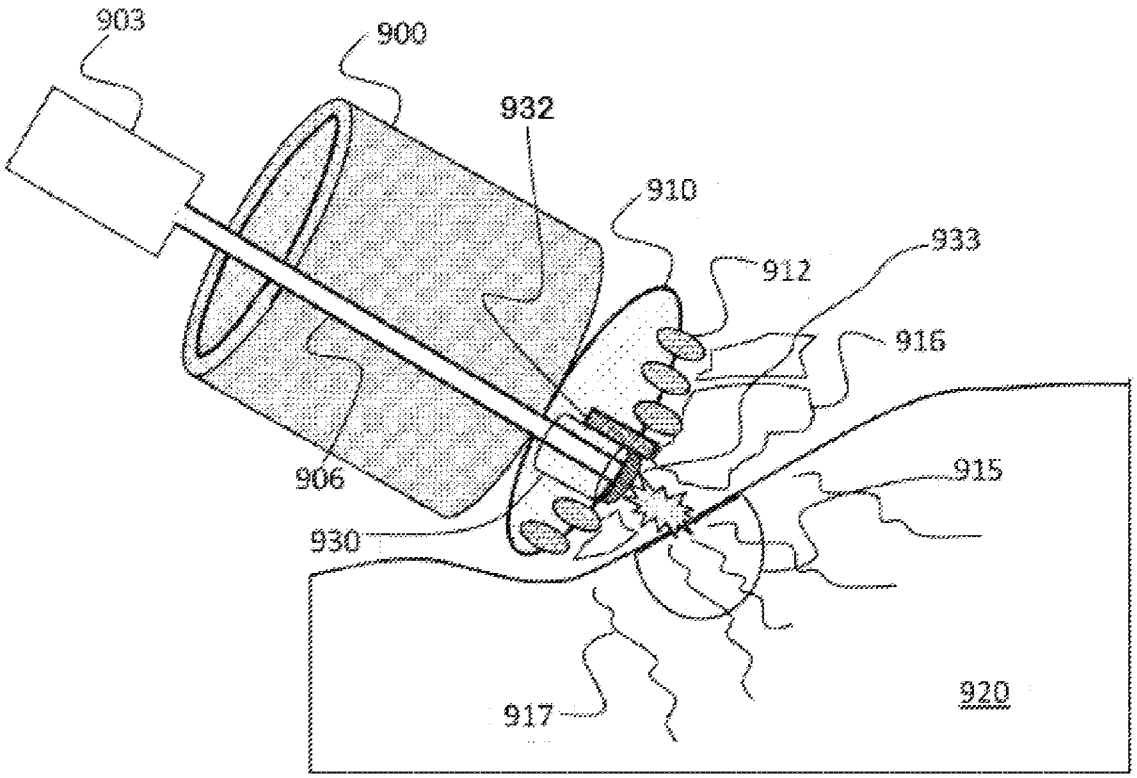
FIG. 10 illustrates a laser assisted, mechanical drilling system in accordance with one embodiment of the present invention.

FIG. 10 illustrates a laser assisted, mechanical drilling system in accordance with one embodiment of the present invention. The drilling system may comprise a bottomhole assembly 900 and a drill bit 910.

In FIG. 10, a laser source 903 may be used to produce a laser energy output. The laser energy output from the laser source 903 may be passed to a tool face of the drill bit 910 via an energy transmission conduit 906. The energy transmission conduit 906 may comprise a light pipe, an optical fiber and/or the like.

As will be appreciated by persons skilled in the art, the laser source 903 could be another type of electromagnetic energy source, such as an electropulse source or the like, and the energy transmission conduit 906 may comprise a corresponding type of electromagnetic energy transmission conduit, such as an electrode.

As noted above, steps may be taken, such as use of transmissive fluids or the like, to provide for transmission of electromagnetic energy from the energy source, through the mechanical drill bit to the earth formation. In embodiments of the present invention, an electromagnetic transmission conduit or the like may take the electromagnetic energy to the tool face of the drill bit or even through a one of the mechanical cutters or a protuberance on the drill bit. While directing electromagnetic energy down a longitudinal axis of the drill bit may be quite simple, in some embodiments of the present invention, the electromagnetic energy may be directed to off-center locations on the drill bit face.

Applicants have found that directing energy to the drill bit face, especially through the cutters or a protuberance on the drill bit, which may be referred to as an electromagnetic cutter, provides for direct interaction of the electromagnetic energy with the earth formation. In some aspects, the electromagnetic cutter not extend as far as the mechanical cutters from the drill bit face and the electromagnetic energy may be directed at cuttings produced by the mechanical cutters.

The laser source 903 may be disposed in the drill bit 910, in the bottomhole assembly 900, in drill pipe (not shown) above the bottomhole assembly 900, at a surface location and/or the like. The energy transmission conduit 906 transmits energy from the laser source 903 to the tool face and into an earth formation 920 being drilled by the drilling system.

In some embodiments, the laser energy from the laser source 903 passes through an optical delivery system 930 and onto/into the earth formation 920. The optical delivery system 930 may comprise optical elements lenses, beam shaping optics and/or the like and may be encased in a protective optical head made of, for example, steel, chrome-moly steel, steel cladded with hard-face materials such as an alloy of chromium-nickel-cobalt, titanium, tungsten carbide, diamond, sapphire, and/or other materials and may comprise a transmissive window 933 to emit the laser energy. The transmissive window 933 may comprise sapphire, diamond, boron doped diamond and/or the like. In some aspects the optical delivery system 930 may comprise only the transmissive window 933 and the transmissive window 933 may be shaped to focus the laser energy.

The optical delivery system 930 may be disposed in/integrated into the drill bit 910 so that the optical delivery system 930 is appurtenant to or in contact with the earth formation 920. In some embodiments, the optical delivery system 930 may be disposed in/integrated with one of the mechanical cutters 912. In other embodiments the optical delivery system 930 may be disposed appurtenant to the mechanical cutters 912. In some aspects, the optical delivery system 930 may not extend as far from a body of the drill bit 910 as the mechanical cutters 912. In aspects of the present invention, by positioning the optical delivery system 930 millimeters or tens of millimeters behind the reach of the mechanical cutters 912, the laser energy may be effectively transmitted into the earth formation 920 and the transmissive window 933 of the optical delivery system 930 may be protected from adverse contact effects with the earth formation 920.

In one embodiment, the electromagnetic energy may be directed through the drill bit 910 to an off-center location on the tool face of the drill bit 910. Off-center delivery of the electromagnetic energy can increase the effectiveness of the mechanical cutters 912 and/or provide for control of a direction of cutting of the drill bit 910.

In some embodiments, a protective element 932 may be disposed next to the optical delivery system 930. The protective element may comprise a protuberance, a lip, a cylinder or the like, that may extend the same distance out from the body of the drill bit 910 to the same extent or slightly further than the optical delivery system 930 so as to provide protection for the transmissive window 933.

As illustrated in FIG. 10 laser light may be ported directly through the mechanical cutter 912 and/or the drill bit 910 onto the earth formation 920. This direct path to the target negates non-transmissive properties of fluids in the wellbore. As shown in FIG. 1, the laser energy may heat/interact with the rock in a laser interaction zone 915. The laser energy and/or the mechanical cutters may cause damage, such as small fractures 917, to the earth formation 920 and remove cuttings 916 from the earth formation 920. In some embodiments of the present invention, the rock may be damaged by the laser energy then removed by the mechanical cutter 912.

The optical path through the mechanical cutter 912 and/or the drill bit 910 may be provided by a fixed light path that may be eroded back as the mechanical cutter 912 and/or the tool face of the drill bit 910. The optical path may comprise a high temperature optically transparent material such as chemically vapor deposited (CVD) diamond or the like.

In some embodiments, the mechanical cutter 912 may comprise shaped cutters, such as stinger cutters that extend almost along a longitudinal axis of the drill bit 910. In such configurations, the light path within the cutter may not have to be deviated much if at all as the cutters axis of symmetry is nearly perpendicular to the rock. In some embodiments, the laser energy may be ported through the side of the mechanical cutter 912 and/or the drill bit 910 so that it weakens the rock in the path of adjacent cutters—effectively side exiting the mechanical cutter 912 and/or the drill bit 910.

On some embodiments, the laser energy delivery system shown in FIG. 10 may be used with hole openers, under reamers, milling systems, concentric reamers, bi-centered drill bits and/or the like.

In some embodiments of the present invention, the laser energy needs to provide thermal energy to the rock in order to weaken (but not melt it) without producing thermal degradation of the mechanical cutter 912 and/or the drill bit 910. In embodiments of the present invention, thermal degradation may be mitigated by cooling from the fluid, use of hard wearing reflective coatings; blocking of reflected light energy by control/adjustment of the opacity of the drilling fluid; modulation of the light energy into pulse streams, i.e., reducing the average energy whilst maintaining the energy peaks to cause disruption; modulation of light energy level in response to the specific rock formation being drilled; modulation of the light energy within one rotation of the bit to adjust to the heterogeneity of the rock (different rock require different levels of disruption); modulation of the light energy to cut specific patterns of weakness into the rock face to strategically weaken the rock (no need to weaken the whole surface volume just produce patterns/designs); modulating the speed of drilling to maintain thermal limits within acceptable bounds (this may involve significant speed modulation within one revolution of the bit—requiring a relatively high speed bit local control of RPM—preferably servoed electrical or hydraulic motor); modulating the flow of coolant and/or the like.

In some embodiments, the drilling system may comprise a drillstring, not shown, that connects the bottomhole assembly 900 to a surface location. The drillstring may comprise a continuous coil tubing or composite pipe with electrical wires implanted in the tube/pipe to deliver electrical energy to the laser source 903. In some embodiments, the electrical power for the laser source 903 may be generated locally using hydraulic energy extracted from the flow of drilling fluid pumped around the wellbore during drilling, which may drive an alternator.

In aspects of the present invention, the conversion of electrical energy to laser light energy may either be done at the surface or down hole. In the former case, the laser source 903 may be disposed at a surface location and a continuous light path may bring the laser energy down the drilling system to the drill bit 912. In the later case, specially hardened electronic and optical systems may be used downhole to produce the laser energy.

In some embodiments of the present invention, where the laser energy is produced downhole, a low shock environment may be provided for the laser source 903 in which the drilling system is self-bracing against the borehole wall to resist linear and rotary vibrations and shocks in all axes. In some embodiments, the laser source 903 may be coupled to the drilling system using polymers/elastomers or the like that may be reactive to applied electrical signals or undergo property changes when a force is applied to them so as to mitigate shock/vibration effects.

In one embodiment, the bottomhole assembly 900 may be coupled with a downhole motor, such as a positive displacement motor, a mud motor, a turbine and/or the like that may be used to drive the drill bit 912. Using the laser source 903 in combination with a downhole motor may reduce the shock/vibration undergone by the laser source 903. Moreover, the downhole motor may also be used at least in part to generate electrical power for the laser source 903.

In one embodiment of the invention, a controller may control the laser source 903 to generate laser energy when the downhole motor is not rotating the drill bit 912. Laser energy may then be directed through the non-rotating drill bit to one or more locations on the formation. After application of the laser source 903, the downhole motor may be activated to rotate the drill bit 912.

In embodiments of the present invention wherein the laser energy is used to make the rock particles break down into a plasma, laser induced breakdown spectroscopy (LIBS) may be applied to identify the rock and fluid constituents downhole in real time by using the back reflection of the laser energy up through the energy transmission conduit 906 or by using a nearby sensor within mechanical cutter 912 and/or the drill bit 910. The analysis could be done in total or part within the BHA, within the drill string at the surface or at a more remote location.

In embodiments in which a cable or a light path is used to transmit power/laser energy from the surface down the wellbore, the cable/light path may also be used for communication with the bottom of the wellbore. In such embodiments, the light path may be used to image the rock directly and construct a formation image and/or the control of rate of penetration and direction of the drilling system may be tied into the LIBS information about the rock being drilled.

One issue for any electromagnetic energy assisted drilling system is delivery of power downhole. As such, in some embodiments, one or more downhole sensors (not shown) may be used to sense the performance of the drilling system, components of the drilling system, properties of the earth formation 920 and/or the like and provide data to a downhole controller that may control operation of the electromagnetic source as required.

For example, sensors may monitor the operation of the downhole motor driving the drill bit 912 and electromagnetic energy may be supplied to the earth formation 920 when the downhole motor is not operating as desired, i.e., the rate of rotation of the drill bit falls below a threshold and or the like. In other embodiments, rotation speed of the drill bit 912, rotation speed of the bottomhole assembly 900, cutter wear, direction of drilling may be sensed and sensed data may be passed to the controller. In other embodiments, properties of the earth formation 920, such as rock strength or the like, cutting depth, rate of penetration, drilling fluid pressure, amount of cuttings being produced, downhole temperature and/or the like may be sensed and communicated to the controller.

The controller may be a processor or the like and may control the operation of the electromagnetic source. For example, it may turn the source on/increase power produced by the source when rock strength increases, rate of penetration declines, cuttings build up around the drill bit, drill bit rotation speed declines, cutter wear increases and/or the like. In embodiments, where the electromagnetic source provides electromagnetic energy to multiple locations on the drill bit 910 or to multiple of the mechanical cutters 912, the controller may use the incoming data to control power/turn on delivery of electromagnetic energy at the different locations/cutters.

Accordingly, although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

The invention claimed is:

1. A system for drilling a borehole in a formation, comprising:

a drill bit comprising:

a bit body and a tool face, wherein the tool face comprises a plurality of mechanical cutters and is configured in use to contact the formation and to cut away formation material as the borehole is drilled through the formation;

an electromagnetic energy source positioned off-center from a center line of the drill bit configured to generate electromagnetic energy; and a directed energy member configured to deliver the electromagnetic energy down a path offset from a longitudinal axis of the drill bit to an off-center location on the tool face to fracture a portion of the formation or cuttings produced by the mechanical cutters.

2. The system as recited in claim 1, wherein the directed energy member delivers the electromagnetic energy to one or more of the plurality of mechanical cutters.

3. The system as recited in claim 1, wherein the directed energy member delivers the electromagnetic energy to one or more protuberances on the tool face.

4. The system as recited in claim 1, wherein the directed energy member comprises a head section that is configured to contact the formation.

5. The system as recited in claim 4, wherein the head section comprises at least one of steel, chrome-moly steel, steel cladded with a hard-face material comprising one of an alloy of chromium-nickel-cobalt, titanium, tungsten carbide, diamond, boron doped diamond and sapphire.

6. The system as recited in claim 1, further comprising:

a downhole motor configured in use to rotate the drill bit.

7. The system as recited in claim 1, further comprising:

a directional controller to control application of energy from the electromagnetic energy source to specific locations on the formation.

8. The system as recited in claim 1, wherein the electromagnetic energy source comprises a laser.

9. The system as recited in claim 8, further comprising:

a fluid source configured in use to direct a flow of a fluid that is transparent to laser energy generated by the laser in front of the tool face.

10. The system as recited in claim 1, wherein the electromagnetic energy source comprises an electric pulse mechanism.

11. A method of drilling a borehole, comprising:

boring a hole through a formation with a drill bit comprising a tool face for contacting the formation, wherein the tool face comprises a plurality of mechanical cutters to cut away formation material as the borehole is formed; and directing electromagnetic energy from an electromagnetic energy source that is positioned off-center from a center line of the drill bit through one or more off-center locations of the tool face against the formation to fracture portions of the formation or cuttings produced by the mechanical cutters proximate the tool face.

12. The method as recited in claim 11, wherein the electromagnetic energy is directed through at least one of the mechanical cutters.

13. The method as recited in claim 11, wherein the electromagnetic energy is directed through at least one protuberance on the tool face.

14. The method as recited in claim 11, further comprising:

pumping a fluid across the tool face prior to directing the electromagnetic energy against the formation or cuttings.

15. The method as recited in claim 11, wherein directing comprises using the electromagnetic energy for side-cutting to create a deviated wellbore.

16. The method as recited in claim 11, further comprising:

using a downhole motor to rotate the drill bit against the formation.

17. The method as recited in claim 16, further comprising:

monitoring performance of the downhole motor; and activating the electromagnetic source based upon the performance of the downhole motor.

18. The method as recited in claim 11, wherein directing comprises selectively applying the electromagnetic energy against the formation.

19. The method as recited in claim 11, wherein directing comprises directing laser energy.

20. The method as recited in claim 19, further comprising:

detecting backscatter or reflections of the laser energy from the formation or cuttings.

21. The method as recited in claim 19, further comprising:

using the laser energy to detect wear of the tool face.

22. The method as recited in claim 11, wherein directing comprises directing electric pulses.

23. The method as recited in claim 11, further comprising:

utilizing the electromagnetic energy for imaging.

24. The method as recited in claim 11, wherein directing comprises directing electromagnetic energy through at least one electrode disposed on the tool face.

25. The method as recited in claim 11, wherein directing comprises directing electromagnetic energy through at least one lens disposed on the tool face.

26. The method as recited in claim 11, further comprising:

monitoring performance of the drill bit; and activating the electromagnetic source based upon the performance of the drill bit.

27. The method as recited in claim 26, wherein the performance of the drill bit comprises at least one of a rate of rotation of the drill bit, a depth of cut of the drill bit, a rate of penetration of the drill bit, a direction of drilling of the drill bit.

28. The method as recited in claim 11, further comprising:

monitoring properties of the formation; and activating the electromagnetic source based upon the properties of the formation.

* * * * *